US008191624B2

(12) United States Patent
Phloi-montri et al.

(10) Patent No.: US 8,191,624 B2
(45) **Date of Patent: *Jun. 5, 2012**

(54) BYPASS GAS LIFT SYSTEM FOR PRODUCING A WELL

(75) Inventors: Pramote Phloi-montri, Bangkok (TH); Chatchai Kongdachudomkul, Bangkok (TH); Thanawee Kreethapon, Bangkok (TH); Pattana Pittrapan, Bangkok (TH); Suwin Sompopsart, Bangkok (TH); Wararit Toempromraj, Bangkok (TH)

(73) Assignee: PTT Exploration and Production Public Company Limited., Bangkok (TH)

( * ) Notice: Subject to any disclaimer, the term of this patent is extended or adjusted under 35 U.S.C. 154(b) by 147 days.

This patent is subject to a terminal disclaimer.

(21) Appl. No.: 12/539,050

(22) Filed: Aug. 11, 2009

(65) Prior Publication Data

US 2010/0032153 A1 Feb. 11, 2010

Related U.S. Application Data

(63) Continuation-in-part of application No. 11/871,746, filed on Oct. 12, 2007, now Pat. No. 7,770,637.

(51) Int. Cl.
*E21B 33/12* (2006.01)
*E21B 43/16* (2006.01)

(52) U.S. Cl. ..... 166/129; 166/401; 166/269

(58) Field of Classification Search ..... 166/401, 166/269, 306, 372, 129, 126, 131, 142
See application file for complete search history.

(56) References Cited

U.S. PATENT DOCUMENTS

| | | | | |
|---|---|---|---|---|
| 4,407,362 | A * | 10/1983 | Bechthold | 166/117.5 |
| 4,708,595 | A | 11/1987 | Maloney et al. | |
| 2003/0056958 | A1 | 3/2003 | Allan | |
| 2006/0076140 | A1 | 4/2006 | Rouen | |
| 2006/0113082 | A1 | 6/2006 | Moffett et al. | |

* cited by examiner

*Primary Examiner* — Cathleen Hutchins
(74) *Attorney, Agent, or Firm* — Westerman, Hattori, Daniels & Adrian, LLP

(57) ABSTRACT

A completion system delivers lifting gas supplied from the surface via a casing annulus through the packer for injecting to the wellbore at bottom hole. So, lifting gas maximizes hydrocarbon producing from a subterranean well while maintaining integrity and serviceability as a typical gas lift well. More specifically, a single completion system uses the same tubing string for both producing the well and delivering lifting gas to the wellbore at downhole. The top section of the tubing is used for producing the well, while the bottom section of the tubing is used for delivering lifting gas for injecting at bottom hole. The lifting gas will be injected to the wellbore proximately at perforation intervals for helping unloading liquid and producing the well. The use of modified equipment named "TK Bypass Mandrel" and "JP Bypass Nipple Sub" allows delivering and controlling of the lifting gas for injecting at bottom hole via a single tubing string.

13 Claims, 7 Drawing Sheets

BYPASS GAS LIFT SYSTEM FOR PRODUCING A WELL

This application is a Continuation-in-Part of U.S. application Ser. No. 11/871,746, filed on Oct. 12, 2007, which is incorporated herein by reference.

FIELD OF THE INVENTION

The present invention relates to petroleum engineering in the discipline of well completion and gas lift technique.

BACKGROUND OF THE INVENTION

A gas lift system is a normal artificial lift technique using worldwide for unloading and producing fluid from the perforation intervals below the packer of a subterranean well.

FIG. 1 illustrates a typical gas lift system which utilizes lifting gas supplied from surface via a casing annulus 7 for injecting into the tubing string 6 via gas lift valves installed in the side pocket mandrels 8 or 9 or 10 above the packer 12. The lifting gas is injected into the tubing string 6 as gas bubbles 11. These gas bubbles 11 decrease the hydrostatic pressure of the fluid column exerting on the perforation intervals (15, 16) below the packer 12. Therefore, the hydrocarbon fluids from the said perforation intervals can flow to the wellbore and to the surface.

In general, the lifting efficiency of a typical gas lift well is governed by many parameters. One which mainly affects the lifting efficiency is an injection depth. It is well-known that the deeper the gas injection depth, the better the lifting efficiency and production of the well can be expected.

With respect to FIG. 1, the maximum gas injection depth of a typical gas lift well is limited by the setting depth of the packer 12 above the top perforation interval 15. Thereby, some gas lift wells which have long vertical distance between perforation intervals e.g. hundreds meter of the vertical distance between top perforations 15 and bottom perforations 16, will suffer in low or no production from the deeper perforation intervals due to poor lifting efficiency.

Methods and techniques in prior arts are developed for delivering lifting gas for injecting at downhole below the packer, those techniques are different from the present invention in many aspects, for example:

U.S. Pat. No. 4,708,595 entitled "INTERMITTENT OIL WELL GAS-LIFT APPARATUS" discloses an intermittent oil well gas-lift apparatus uses the sidestring tube running from packer to bottom hole for delivering lifting gas for intermittent injecting into the chamber at bottom hole for lifting the liquids flowing therein to the surface.

In contrast, the gas-lift apparatus of the present invention does not run the sidestring tube from the packer to bottom hole and does not inject gas to the tubing or chamber at bottom hole for intermittent lifting the liquid to surface.

Another prior art, US patent application publication number 2006/0076140A1 entitled "GAS LIFT APPARATUS AND METHOD FOR PRODUCING A WELL" discloses a gas-lift apparatus uses another tubular member running from the dual-port packer to bottom hole for injecting gas into the wellbore.

However, there still have the differences between the gas-lift apparatus of the said US application and the present invention, that is, the gas-lift apparatus of the present invention uses a single tubing string and such tubing string is used for both producing the well and injecting gas to the wellbore at bottom hole.

The concept idea of the present invention is to improve the lifting efficiency of the fluid in the well by allowing continuous injecting lifting gas to the wellbore at maximum possible depth below the packer by the use of single tubing string. It also maintains good well integrity and well serviceability with the standard tools and techniques already existing in the oil and gas industry. The main difference of the present invention among other prior arts is that the present invention uses only one tubing string running from the surface to the bottom hole for delivering lifting gas for injecting to the wellbore below the packer while other prior arts use additional tube for injecting gas to the wellbore or to the tubing below the packer. The use of new-modified tools in the present invention allows to short bypass lifting gas from the casing annuls above the packer to enter the tubing string at below the said packer. This enables the whole completion string to run as a single completion and allows performing wireline intervention in the future for repairing or changing equipment installed in the tubing string below the packer.

SUMMARY OF THE INVENTION

The present invention is an applied gas lift technique for maximizing hydrocarbon production from a subterranean well by allowing continuous injecting gas to the wellbore at maximum possible depth below a production packer as lifting gas. The present invention allows using only one tubing string running from the surface to the bottom hole for both producing the well and delivering lifting gas to the bottom hole. There maybe at least one side pocket mandrel and gas lift valve installing in the tubing string both above and below the packer for injecting lifting gas into the tubing string and to the wellbore outside the tubing string respectively.

In another aspect of the present invention, the use of the new-modified tools allows bypass delivering lifting gas pass thru the packer via a short distance tube. Lifting gas is controlled to re-enter the tubing string at below the packer for injecting to bottom hole. In other words, the present invention can be run as a single completion. In addition, the use of the short distance tube for delivering lifting gas reduces pressure drop in the total gas delivering system.

In another aspect of the present invention, the use of single tubing string for injecting lifting gas to the wellbore at the bottom hole allows performing well maintenance and well servicing of the equipment installed at below the packer by standard wireline tools and techniques possible. This is the most beneficial of the present invention since it allows operator to adjust or to plug the gas injection and to repair or to change the device at below the packer for optimizing the production during the well life.

DETAILED DESCRIPTION OF THE PREFERRED EMBODIMENT

The present invention is aimed to develop new technique which allows injecting lifting gas to the wellbore proximate at perforation intervals below the packer to maximize producing hydrocarbon from the well while maintain integrity, reliability, and serviceability similar to the typical gas lift system well in FIG. 1.

Figure 1:
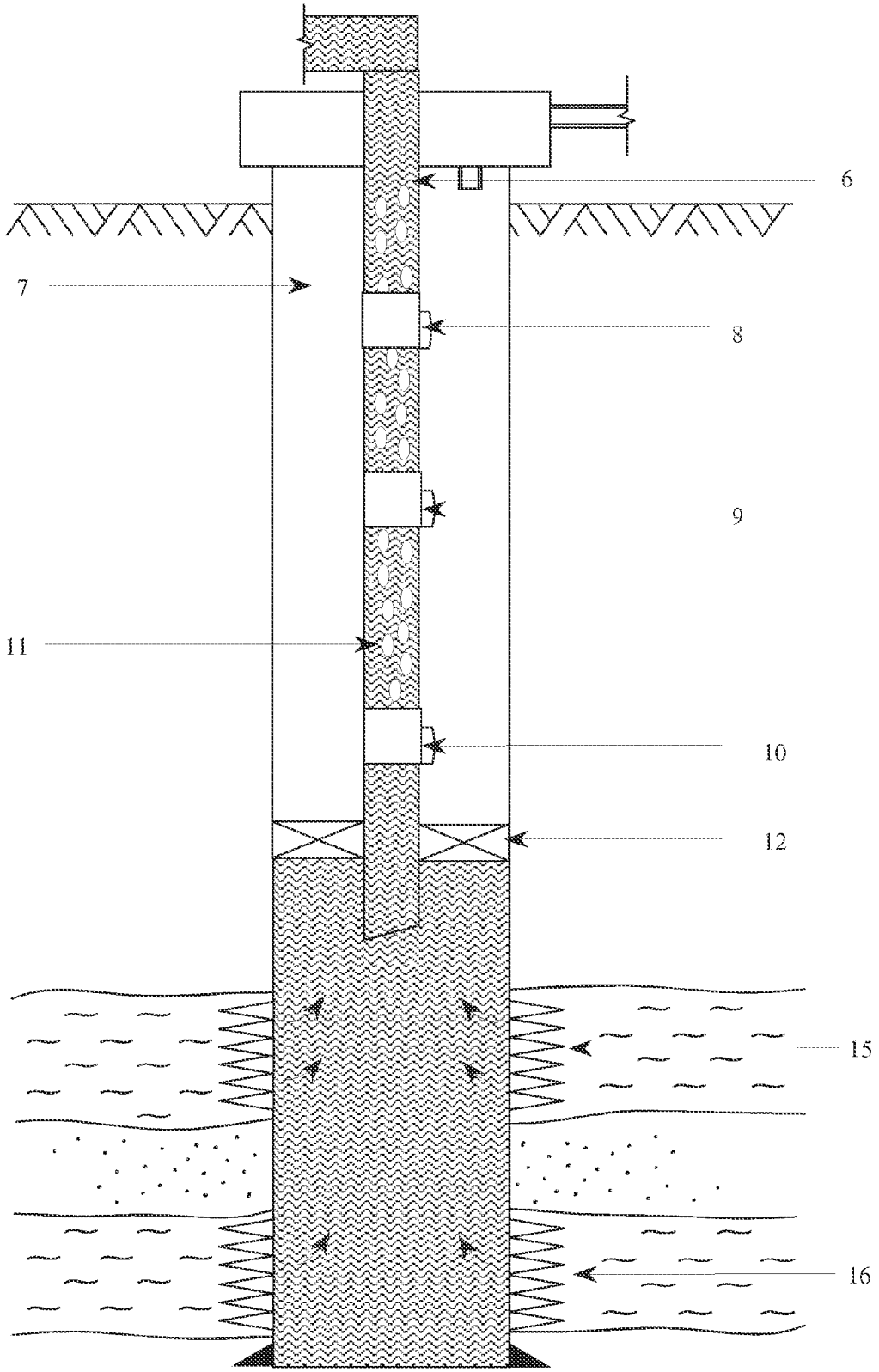
FIG. 1 illustrates a partial cross sectional view of a typical gas lift system.

A preferred embodiment of the gas-lift system according to the present invention will now be described with reference to FIG. 2-7, wherein the components of the gas-lift system, which are identical with the components of the typical gas lift system of FIG. 1 are identified by like numerals.

Figure 2:
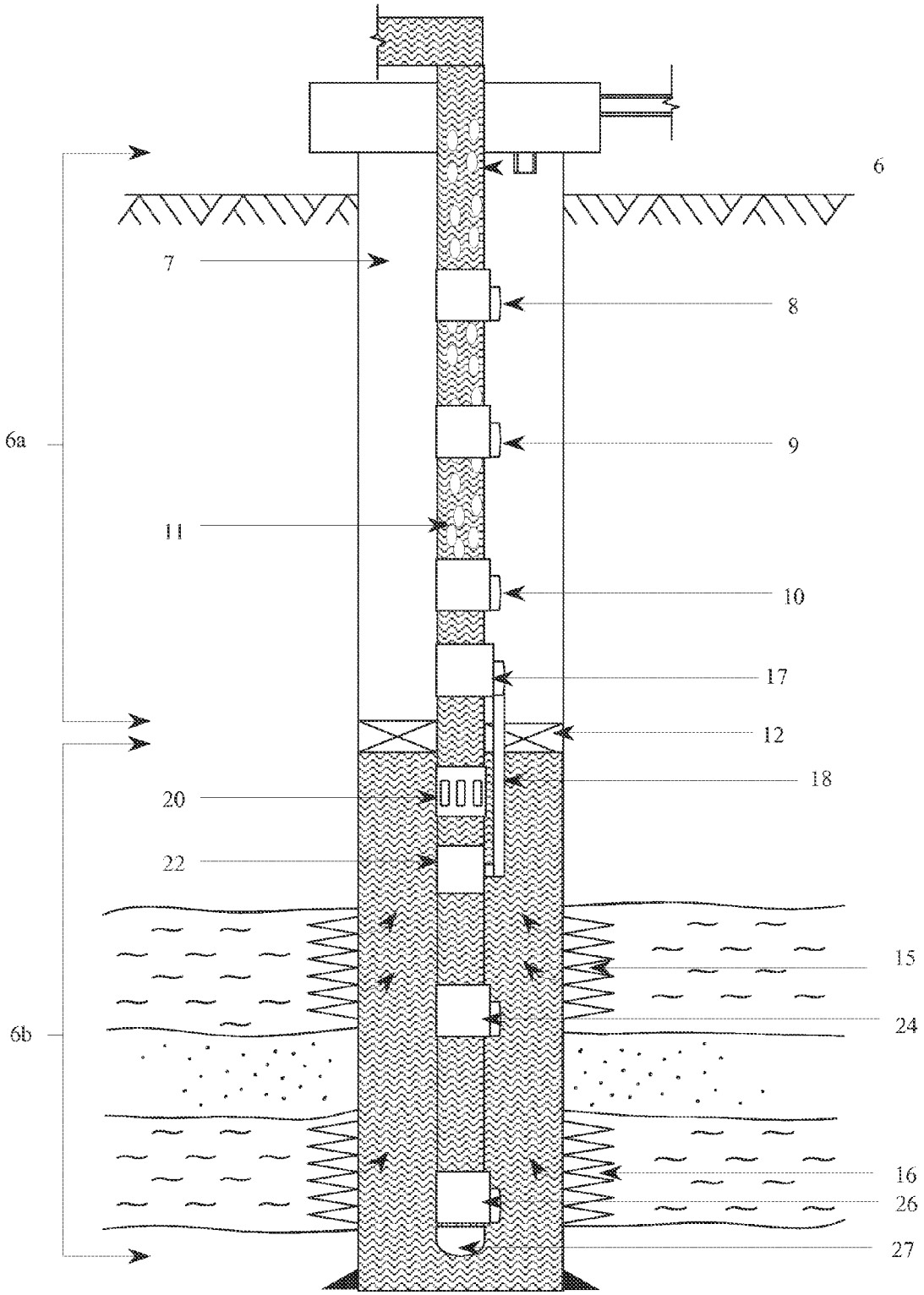
FIG. 2 illustrates a partial cross sectional view of the bypass gas lift system of the present invention, which is operated like a typical gas lift system.
Figure 3:
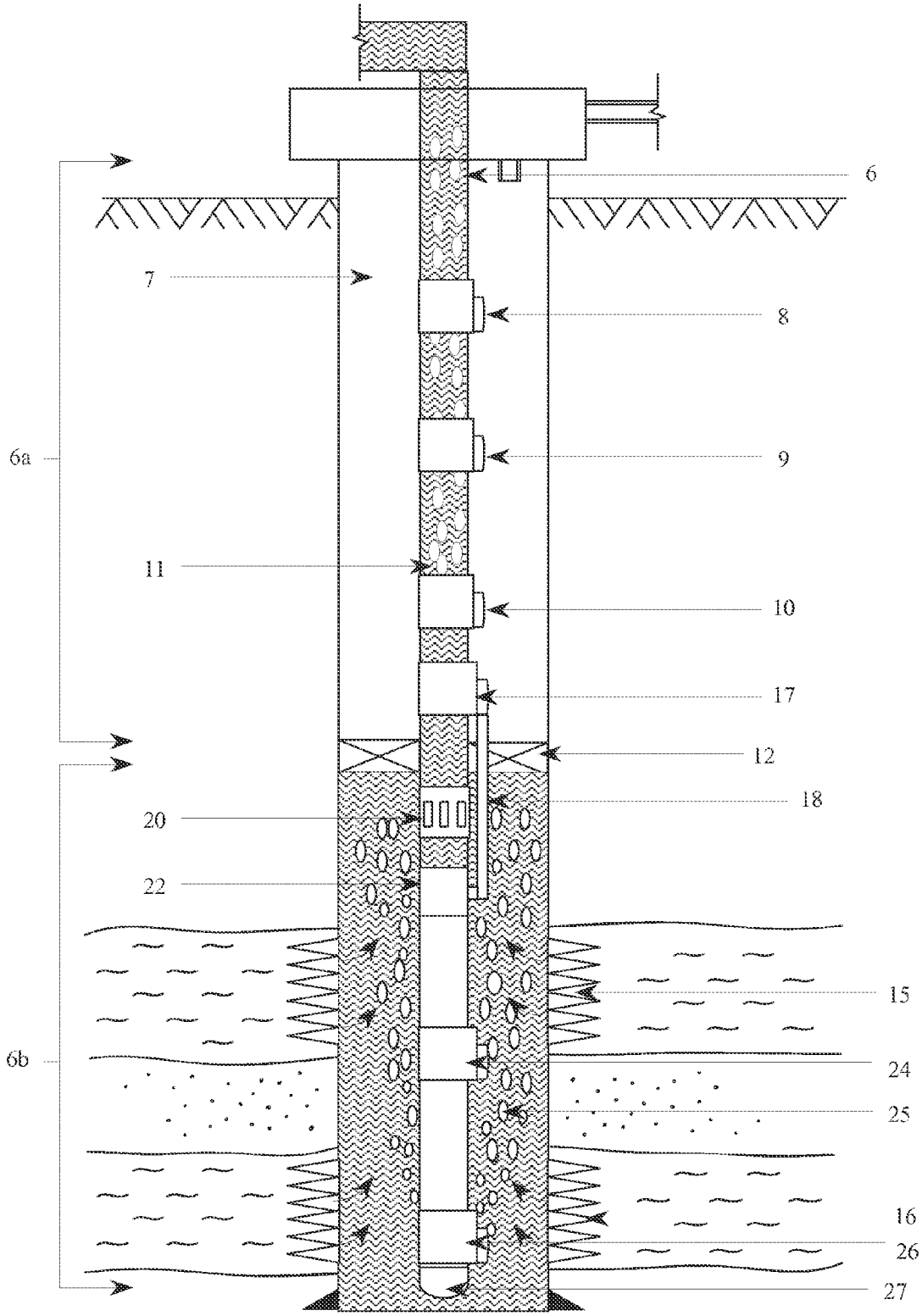
FIG. 3 illustrates a partial cross sectional view of the bypass gas lift system of the present invention, which is operated for continuous injecting lifting gas to the wellbore at the bottom hole to help producing hydrocarbon fluids from the perforation intervals.

As shown in FIG. 2 and FIG. 3, an embodiment of the gas-lift system of the present invention comprises a casing annulus 7 and a tubing string 6 (e.g. 2-⅜", 2-⅞", or 3-½") running from the surface to the down hole. The size of the tubing string 6 can be varied from well to well depends on the well conditions. For example, the tubing string 6 may have an outside diameter of 2-⅜", 2-⅞" or 3-½".

A sealing mechanism 12, such as a packer, is provided above the perforation intervals (15, 16) for sealing the casing annulus 7, thus dividing the tubing string 6 into two parts, the first part 6*a* defined as the part of the tubing string 6 above the packer 12 and the second part 6*b* defined as the part of the tubing string 6 below the packer 12 proximate the perforation intervals (15, 16). The first part 6*a* of the tubing string 6 is used for producing the well while the second part 6*b* of the tubing string 6 is used for delivering lifting gas to the down hole. More particularly, the sealing mechanism 12 is a dual-port packer, which has at least two ports; one port is for adapting with the tubing 6 for producing the well and another smaller port is for adapting with a small tube 18.

At least one gas lift valve and side pocket mandrels (8 or 9 or 10) may be installed in the first part 6*a* of the tubing string 6 for injecting gas from the casing annulus 7 into the first part tubing string 6*a* for unloading liquid and producing the well.

The gas-lift system of this invention also comprises a bypass mechanism for allowing lifting gas from the casing annulus 7 to pass thru the dual-port packer 12 and delivering such lifting gas to enter the second part tubing string 6*b* at below the dual-port packer 12 for flowing to the bottom hole.

In one embodiment, this invention uses features of a modified tool named "TK Bypass Mandrel" 17 being coupled with the lower part of the first part tubing string 6*a*. The tube of the "TK Bypass Mandrel" 17 is connected to one end of the tube 18 appropriate in size, such as the tube 18 may has an outside diameter of 1-¼", 1-½" or 2". The "TK Bypass Mandrel" 17 is used for controlling and delivering lifting gas supplied from casing annulus 7 above the dual-port packer 12 to pass thru the said packer via the tube 18. Further, a modified tool named "JP Bypass Nipple Sub" 22 is coupled with the second part tubing string 6*b* below the dual-port packer 12 and sliding side door 20. The small tube of the "JP Bypass Nipple Sub" 22 is connected to the other end of the tube 18 for receiving lifting gas from the tube 18 and delivering lifting gas to the tubing string 6*b* adapted below it.

Figure 4:
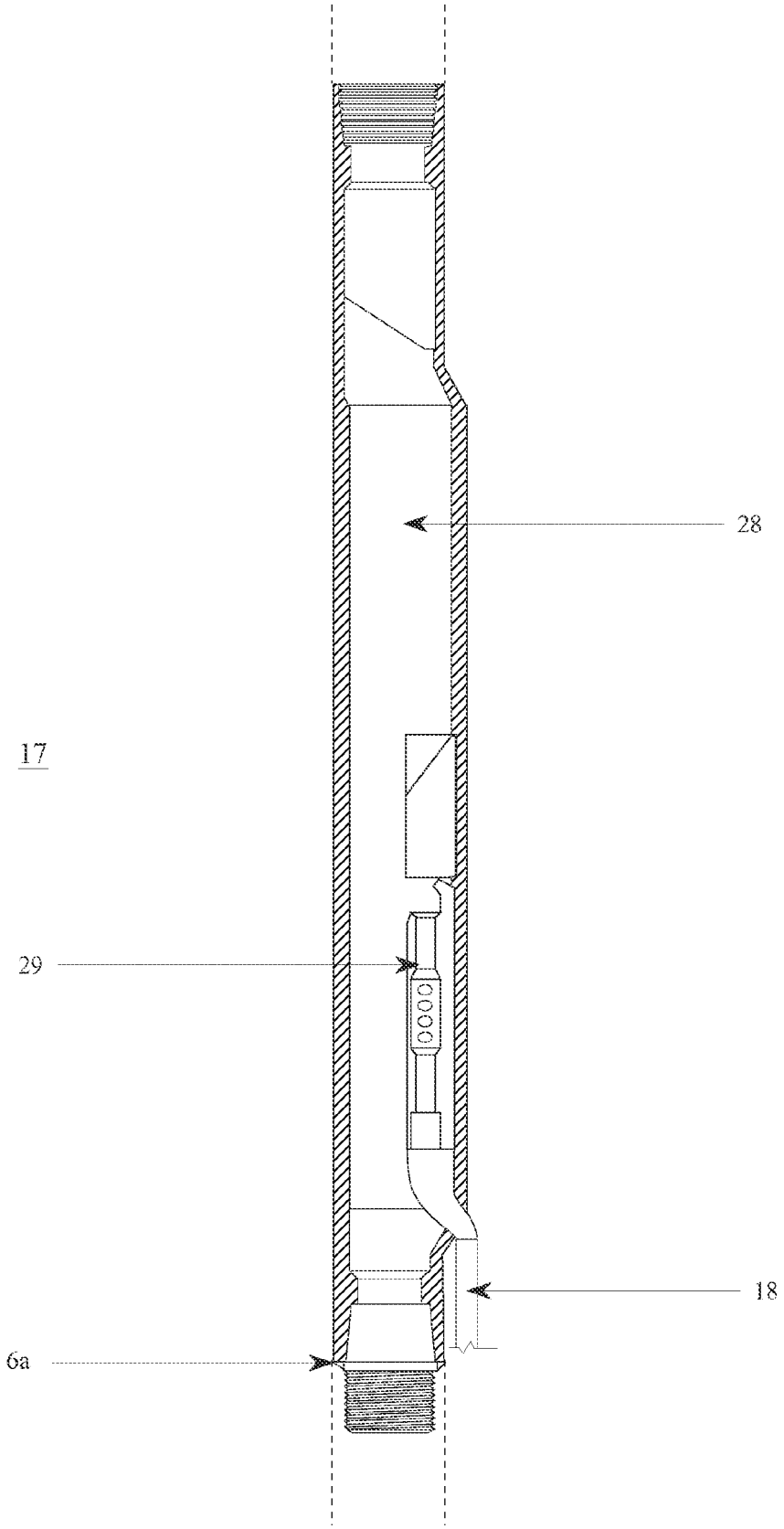
FIG. 4 illustrates a cross sectional view of an embodiment of the "TK bypass mandrel" used in the present invention for delivering lifting gas from casing annulus to pass thru the packer via a small tube.

Next, the details and the operation of the bypass mechanism will be described by accompanying with the drawings. With respect to FIG. 4 showing the detail of the "TK bypass mandrel" together with FIG. 2 and FIG. 3, the "TK bypass mandrel" 17 is modified from a typical side pocket mandrel body 28 to have a tube 18 adapted below a pocket 29. The "TK bypass mandrel" 17 can be installed and operated like a typical side pocket mandrel. When require operating the gas-lift system of this invention as a typical gas-lift well, a typical dummy gas lift valve may be installed inside the pocket 29 for shutting the gas flowing thru the "TK Bypass Mandrel" 17 to below the dual-port packer 12.

When require operating as shown in FIG. 3 for continuous injecting lifting gas to the bottom hole, a typical orifice valve maybe installed inside the pocket 29 for allowing the gas flowing thru the "TK Bypass Mandrel" 17 to below the dual-port packer 12 for injecting to the wellbore as lifting gas. The said orifice valve can be changed by wireline intervention when required changing gas rate. The "TK Bypass Mandrel" 17 can be installed in the first part tubing string 6*a* as a typical side pocket mandrel (8, 9, 10). Preferably, it should be placed below the bottom most side pocket mandrel 10 in the first part tubing string 6*a* but above the dual-port packer 12.

After the gas passing thru the "TK Bypass Mandrel" 17, it will flow via the tube 18 and pass thru the dual-port packer 12 to the "JP Bypass Nipple Sub" 22, which is installed in the second part tubing string 6*b* below the dual-port packer 12. The "JP Bypass Nipple Sub" 22 is used for diverting lifting gas flowing from the tube 18 to the bottom hole via the second part tubing string 6*b*, which is adapted below the "JP Bypass Nipple Sub" 22.

Figure 5:
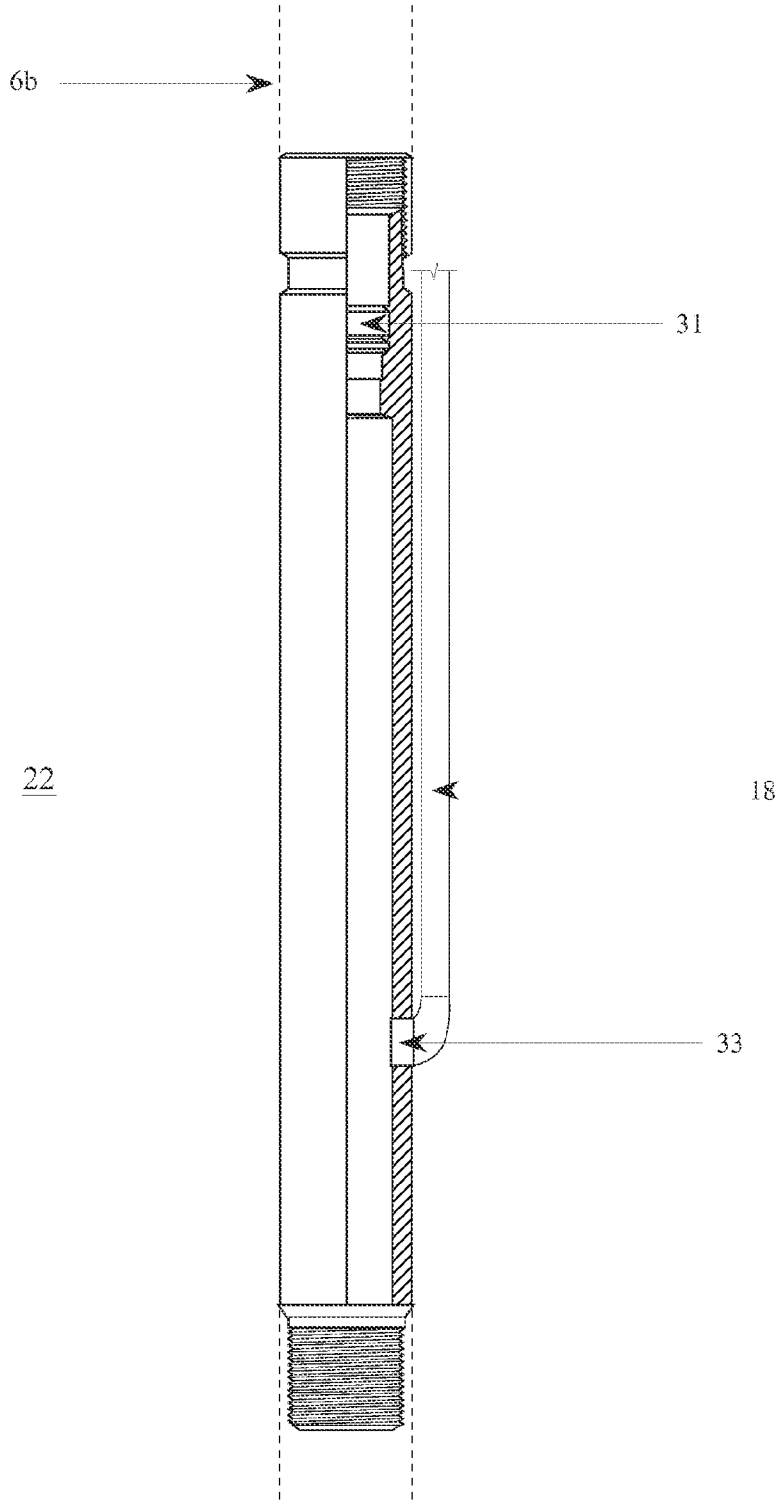
FIG. 5 illustrates a partial cross sectional view of an embodiment of the "JP bypass nipple sub" used in the present invention for receiving lifting gas from a small tube and delivering lifting gas to the tubing string adapted below it.

With respect to FIG. 5 together with FIG. 3, the "JP Bypass Nipple Sub" 22 can be modified from a typical seating nipple to have one side-port 33 adapted for receiving gas flowing from the tube 18. The nipple profile 31 at the top section of the "JP bypass nipple sub" body is prepared for receiving a typical wireline plug for sealing gas pressure when requiring injecting lifting gas down to the bottom hole below the dual-port packer 12 via the second part tubing string 6*b*.

In addition, the gas-lift system of the present invention may comprises an opening/closing mechanism or a port being installed at below the dual-port packer 12 and above the "JP Bypass Nipple Sub" 22 for allowing the fluid produced from the perforation intervals (15, 16) to enter the tubing string 6*b* above the "JP Bypass Nipple Sub" 22 and flow to surface via the tubing string 6*a*. Such mechanism may be a sliding side door 20, which have size equivalent to the nominal size of the second part tubing string 6*b*.

Further, a bull plug 27 is installed at bottom end of the second part tubing string 6*b* for sealing gas pressure and preventing wireline tools passing to the wellbore outside.

Optionally, one or more gas injection valve being inside the side pocket mandrel (24, 26) may be installed in the second part tubing string 6*b* below the dual-port packer 12 for injecting lifting gas to the wellbore proximate perforation intervals (15,16).

Figure 6:
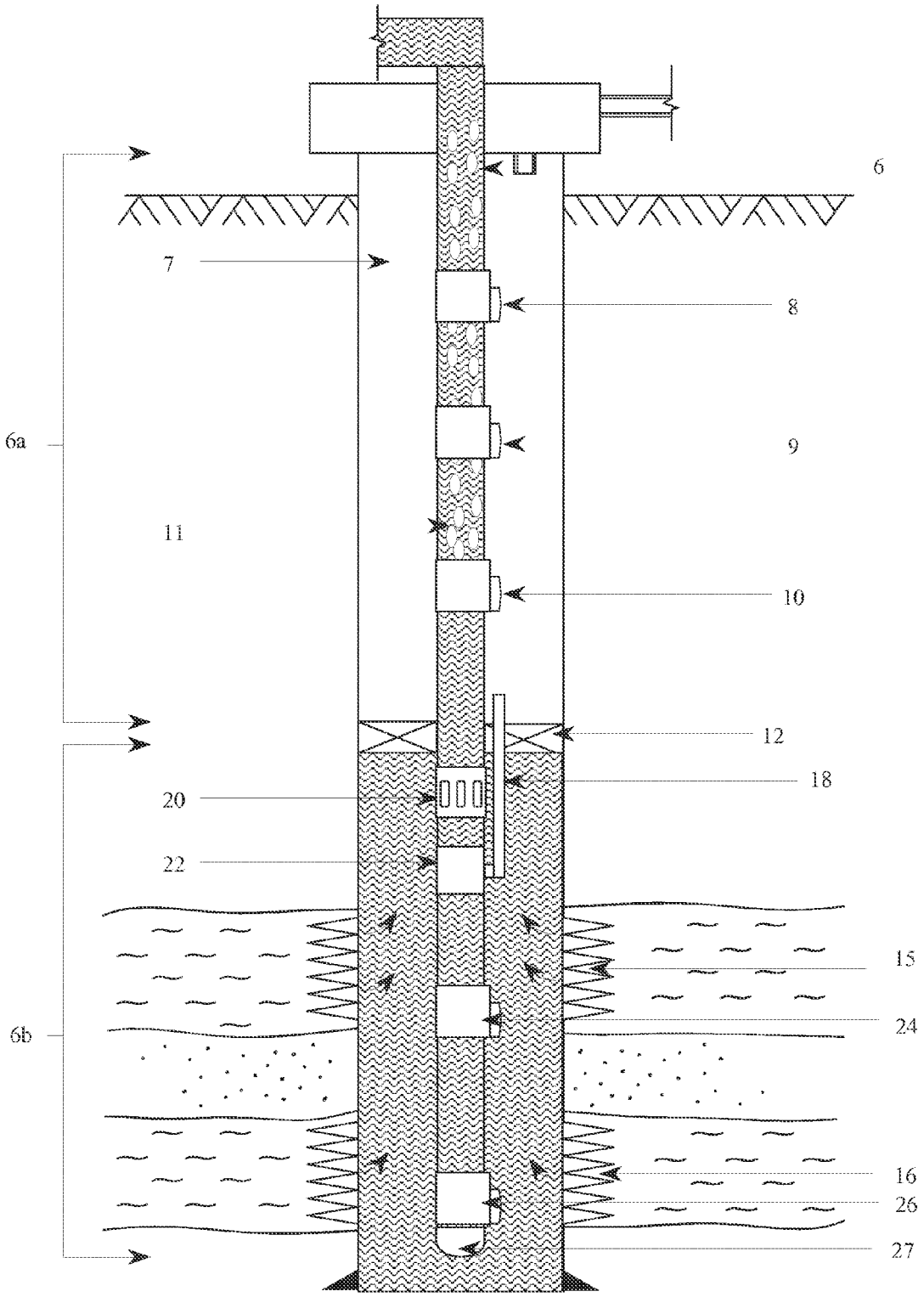
FIG. 6 illustrates a partial cross sectional view of an alternative embodiment of the bypass gas lift system of the present invention.

Yet, another embodiment of the bypass gas lift system according to this invention is shown in FIG. 6. The bypass gas lift system also comprises a casing annulus 7, a tubing string 6 and at least one gas lift valve and side pocket mandrels (8,9,10) installed in the first part 6*a* of the tubing string 6. A sealing mechanism 12, in this embodiment, is a dual-port packer, in which one port is for applying to the tubing 6 while another smaller port is for applying to a tube 18.

Also, the gas lift system comprises the bypass mechanism for delivering lifting gas from the casing annulus 7 to enter the second part tubing string 6*b*. Unlike the bypass mechanism of the prior embodiment, this embodiment do not require the "TK Bypass Mandrel" 17, it utilizes the tube 18, which allows the lifting gas to flow from the casing annulus 7 thru the dual-port packer 12 and enter the second part tubing string 6*b* via "JP Bypass Nipple Sub" 22 coupled with the second part tubing string 6*b* below the packer 12 and a sliding door 20. The "JP Bypass Nipple Sub" 22 of this embodiment may have the structure as described previously accompanying by FIG. 5.

In operation, the gas-lift system of this invention, the system can be operated as a typical gas lift system as shown in FIG. 2 or FIG. 6 at the early stage of the well life should the well still has high reservoir pressures or has low percentage of water cut in the well fluids.

Also, it can be converted for operating as FIG. 3 or FIG. 7 to utilize the bypass gas lift system for injecting lifting gas to the wellbore at the bottom hole later on, once the reservoir pressures in the perforation intervals (15, 16) deplete or the percentage of water cut increases. If operating like the embodiment as shown in FIG. 3, it just requires changing the dummy valve installing inside the "TK Bypass Mandrel" 17 with the orifice valve by wireline intervention. With respect to FIG. 3, the lifting gas is injected to the first part tubing string 6*a* above the dual-port packer 12 as gas bubbles and it is delivered passing thru the said packer 12 by the operation of the "TK Bypass Mandrel" 17 cooperating with the tube 18 used as a conduit for delivering lifting gas to the "JP Bypass Nipple Sub" 22. The "JP Bypass Nipple Sub" 22 receives lifting gas from the tube 18 and delivers such lifting gas down to the bottom hole for injecting to the wellbore proximate at perforation intervals 15 and perforation intervals 16.

Figure 7:
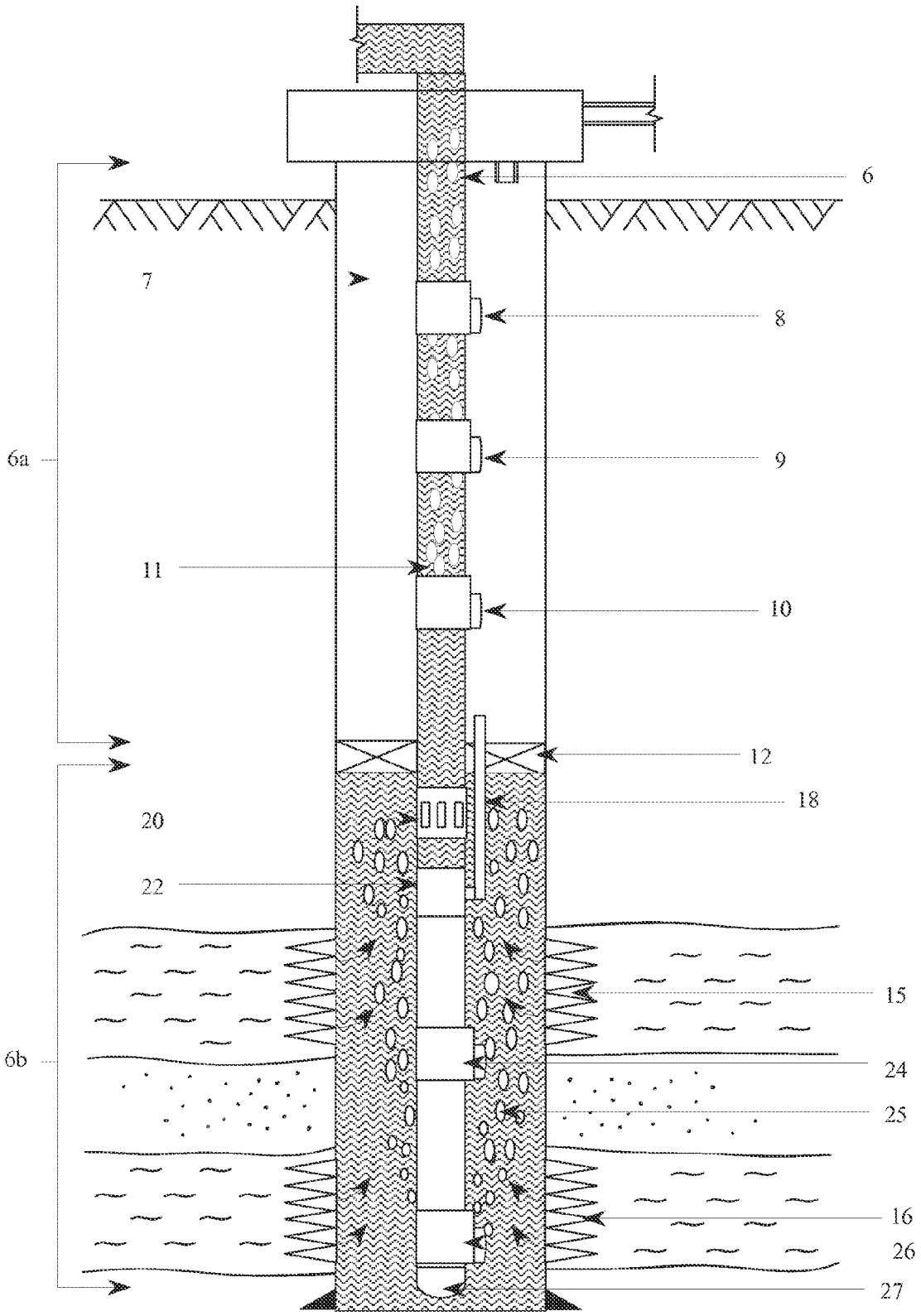
FIG. 7 illustrates a partial cross sectional view of the bypass gas lift system of an alternative embodiment of this invention, which is operated for continuous injecting lifting gas to the wellbore at the bottom hole to help producing hydrocarbon fluids from the perforation intervals.

Otherwise, if operating like another embodiment shown in FIG. 7, the lifting gas being in the casing annulus 7 above the packer 12 will enter the small tube 18 then pass thru the "JP bypass Nipple Sub" 22, which receives and delivers such lifting gas down to the bottom hole for injecting to the wellbore proximate at perforation intervals 15 and perforation interval 16.The gas bubbles 25 will mix and dissolve with the wellbore fluid around the second part tubing string 6*b*. This decreases density and hydrostatic pressure of the wellbore fluid exerting on the perforation intervals (15, 16). Hence, the hydrocarbon fluids from the said perforation intervals (15, 16) can flow to the wellbore and to the surface more efficiently. Besides, the gas-lift system of this invention can be installed as a single completion where there is the first part tubing string 6*a* running from the surface to adapt on the bigger port of the dual-port packer 12 and the second part tubing string 6*b* running from the said packer 12 to the bottom hole.

What is claimed is:

1. A gas injection system for use in a well comprising:

a tubing string running from a surface through a wellbore to proximate perforation intervals; and a sealing mechanism sealing the wellbore above the said perforation intervals;

a bypass mechanism delivering lifting gas from above the sealing mechanism to an opening port coupled to a section of the tubing string that is located below the sealing mechanism;

wherein said tubing string has at least one injection valve below said opening port to inject said lifting gas from the tubing string to the wellbore proximate said perforation intervals below the sealing mechanism.

2. The gas injection system of claim 1, comprising a single tubing string running from the surface to the sealing mechanism and from the sealing mechanism to a bottom hole and has at least one gas injection mechanism installed above the sealing mechanism for injecting lifting gas into the tubing string at a section above the said sealing mechanism and has at least one gas injection mechanism for injecting lifting gas to the wellbore outside the tubing string at a section below the said sealing mechanism.

3. The gas injection system of claim 1, wherein the tubing is adapted to the sealing mechanism, the sealing mechanism is adapted to seal the wellbore above perforation intervals and the sealing mechanism is a dual-port packer which has one port for adapting with the tubing and another port for adapting with a tube for flowing gas.

4. The gas injection system of claim 1, comprising an apparatus for delivering lifting gas above the sealing mechanism to pass thru the sealing mechanism and to re-enter the tubing string below the sealing mechanism and the said apparatus provides a shut-off/control mechanism to shut off the gas injection or to control the gas injection rate.

5. The gas injection system of claim 1, comprising an opening/closing mechanism or a port being installed at below the sealing mechanism for producing fluids from perforation intervals below the sealing mechanism.

6. The gas injection system of claim 5, wherein the opening/closing mechanism or the port is a sliding side door.

7. The gas injection system of claim 1, wherein the tubing string is used for both producing the well and for delivering lifting gas to the bottom hole wherein a top section above the sealing mechanism is used for producing the well while a bottom section below the sealing mechanism is used for delivering lifting gas to the bottom hole.

8. A gas injection system used for producing a well, comprising:

a dual-port packer for sealing a wellbore above perforation intervals;

said packer has one port that adapts with a tubing string and another port that adapts with a tube for delivering gas;

said tubing string running from a surface to the dual-port packer and from the dual-port packer to a bottom hole;

at least one side pocket mandrel and gas lift valve installed in the tubing string above the dual-port packer for injecting gas into the said tubing string;

a bypass that delivers lifting gas from above the dual-port packer to an opening port coupled to a section of the tubing string that is located below the dual-port packer; and at least one gas injection tool installed in the tubing string below the dual-port packer for injecting said lifting gas received from said bypass from the said tubing string to the wellbore.

9. A gas injection system used for producing a well where the system comprising:

a casing annulus and a tubing string running from a surface through a wellbore to proximate perforation intervals or shallower depending on well conditions;

a dual-port packer for sealing the casing annulus above the perforation intervals, the said packer has one port for making up with the tubing string where another port for making up with a tube for delivering gas from the casing annulus above the packer to the tubing string below the packer; and at least one gas injection mandrel installed in the tubing string below the dual-port packer for receiving said gas delivered from the said tube to the tubing string and then injecting said gas into the wellbore.

10. A gas injection system used for producing a well, comprising:

a gas injection mechanism including a side pocket mandrel adapted to mount to a tubing string that passes through a sealing mechanism for delivering gas from the said side pocket mandrel that is received via the tubing string from a tube which passes through one port of the sealing mechanism, whereby receiving gas delivered from above the sealing mechanism to a section of the tubing string that is located below the sealing mechanism and then injecting said gas into a wellbore proximate at least one perforation interval.

11. A gas injection system used for producing a well, comprising:

a gas injection mechanism including a seating nipple having an opening port connected with a tube for receiving gas delivered by the said tube and a side pocket mandrel adapted to receive gas delivered from the seating nipple to a section of a tubing string that is located below a sealing mechanism and then inject said gas into a wellbore proximate at least one perforation interval.

12. A bypass mechanism of a gas injection system which is comprised of a casing annulus and a tubing string running from a surface to a wellbore proximate perforation intervals or shallower which depends on well conditions, and a sealing mechanism for sealing the casing annulus above the perforation intervals, the bypass mechanism is provided for delivering gas from the casing annulus above the sealing mechanism to pass thru the sealing mechanism and flow into the tubing string below the sealing mechanism and is comprised of:

a tube for delivering gas from the casing annulus above the perforation intervals to pass thru the sealing mechanism and flow into the tubing string below the sealing mechanism; and a seating nipple having an opening port connected with said tube for receiving said gas delivered from the said tube into said tubing string and for injecting said gas from said tubing string into the wellbore.

13. A bypass mechanism of a gas injection system, which is comprised of a casing annulus and a tubing string running from a surface through a wellbore to proximate perforation intervals, and a sealing mechanism for sealing the casing annulus above the perforation intervals, the bypass mechanism is provided for delivering gas from the casing annulus above the sealing mechanism to pass thru the sealing mechanism and flow into the tubing string below the sealing mechanism and is comprised of:

a side pocket mandrel having a valve inside said pocket side mandrel, such side pocket mandrel is adapted to have a tube for delivering gas flowing from the said side pocket mandrel to pass thru the sealing mechanism via the tube through one port of the sealing mechanism; and a seating nipple having an opening port connected with the said tube for receiving gas delivered from the said tube and injecting gas into the tubing string below the sealing mechanism and then injecting said gas into the wellbore proximate at least one perforation interval.

* * * * *